US007023389B2

(12) United States Patent
Demicco et al.

(10) Patent No.: US 7,023,389 B2
(45) Date of Patent: Apr. 4, 2006

(54) DETACHABLE ANTENNA MODULE

(75) Inventors: Adam M. Demicco, Davie, FL (US); Ulf Jan-Ove Mattsson, Plantation, FL (US)

(73) Assignee: Motorola, Inc., Schaumburg, IL (US)

( * ) Notice: Subject to any disclaimer, the term of this patent is extended or adjusted under 35 U.S.C. 154(b) by 77 days.

(21) Appl. No.: 10/649,985

(22) Filed: Aug. 26, 2003

(65) Prior Publication Data

US 2005/0057404 A1 Mar. 17, 2005

(51) Int. Cl.
*H01Q 1/24* (2006.01)

(52) U.S. Cl. ..... 343/702

(58) Field of Classification Search ..... 343/702, 343/700 MS, 746, 767, 889; 455/127, 115, 455/571, 128, 129
See application file for complete search history.

(56) References Cited

U.S. PATENT DOCUMENTS 5,898,908 A * 4/1999 Griffin et al. ..... 455/127.2
6,025,816 A * 2/2000 Dent et al. ..... 343/895
6,075,500 A * 6/2000 Kurz et al. ..... 343/895
6,104,350 A * 8/2000 Ng et al. ..... 343/702
6,118,408 A * 9/2000 Yang et al. ..... 343/702
6,430,400 B1 * 8/2002 MacDonald et al. ..... 455/90.1
6,791,497 B1 * 9/2004 Winebrand et al. ..... 343/702
2003/0100262 A1 * 5/2003 Ma ..... 455/41
2004/0257284 A1 * 12/2004 Rada et al. ..... 343/702

* cited by examiner

*Primary Examiner*—Tuyet Vo
*Assistant Examiner*—Huedung X. Cao

(57) ABSTRACT

A detachable antenna module (100) is provided for attachment to a wireless communication device (102) that has a built-in antenna (300). The detachable antenna module (100) includes an external antenna (104), an activation control mechanism (106), and at least one attachment feature (200) for removably attaching the antenna module (100) to the communication device (102) such that the antenna module and the communication device form a single mobile unit when attached. The activation control mechanism (106) selectively electrically couples the external antenna (104) to the communication device (102) when the antenna module is attached to the communication device, so as to selectively route signal transmission and/or reception through either the built-in antenna (300) of the communication device (102) or the external antenna (104) of the antenna module (100) when the antenna module is attached to the communication device. Also provided is a wireless communication device that includes a built-in antenna and such an antenna module.

19 Claims, 3 Drawing Sheets

DETACHABLE ANTENNA MODULE

FIELD OF THE INVENTION

The present invention generally relates to portable electronic communication devices, and more particularly to antenna modules for portable electronic communication devices.

BACKGROUND OF THE INVENTION

Portable electronic communication devices are widely used for business and personal activities and are continually increasing in popularity. In particular, technological advances in electronics and wireless communication, as well as the development of communication infrastructure, have greatly expanded the capabilities of wireless communication and lead to the development of a wide variety of portable electronic communication devices such as wireless phones (e.g., cellular phones), two-way radios (e.g., "walkie-talkies"), pagers and text messaging devices, portable and handheld computers (such as those with a wireless LAN card), internet browsers, personal digital assistants (PDAs), and satellite communication devices such as global positioning systems (GPSs). These devices typically have one or more antennas for signal reception and transmission.

Typically, portable electronic communication devices have either an internal antenna or an external antenna, and each alternative design has inherent advantages and disadvantages. For example, internal antennas generally impart a better aesthetic appearance to a communication device. Furthermore, compared with external antennas, communication devices having internal antennas are more compact and less cumbersome (e.g., the communication device can easily be placed in a pocket, purse, or other carrier without hindrance from an external antenna). They are also less prone to damage (e.g., the antenna is not susceptible to being broken off).

On the other hand, external antennas, such as ¼-wave or ½-wave antennas, generally perform better than internal antennas. For example, external antennas usually have higher gain than internal antennas. The higher gain of external antennas, which for example can be around 5 dB, translates into increased coverage, particularly in fringe areas (i.e., areas where signal coverage is weaker).

Thus, consumers usually must accept a compromise when choosing between either a portable electronic communication device having an internal antenna or one having an external antenna. Consumers who opt for the convenience and aesthetic appearance of an internal antenna must sacrifice the superior performance of an external antenna, and vice versa.

Moreover, neither antenna configuration is optimal in all circumstances. Thus, although a particular customer may prefer either an external or an internal antenna configuration in most circumstances, that customer may commonly encounter situations in which the alternative antenna configuration is desirable. For example, customers who live in areas having good signal coverage may periodically travel to fringe areas. Such customers may generally prefer to own a portable electronic communication device having an internal antenna, but nonetheless would desire the superior performance of an external antenna for those occasions when in fringe areas.

Furthermore, manufacturers are usually limited to choosing a single design for each product. Because some customers opt for internal antennas whereas other customers opt for more powerful external antennas, manufactures are forced to develop separate products to satisfy the different needs of different customers. The need for separate products leads to manufacturing inefficiencies as well as increased costs to the consumer, among other disadvantages.

Therefore a need exists to overcome the problems with the prior art as discussed above.

SUMMARY OF THE INVENTION

Briefly, in accordance with one aspect of the present invention, there is provided a detachable antenna module for attachment to a wireless communication device that has a built-in antenna. The detachable antenna module includes an external antenna, an activation control mechanism, and at least one attachment feature for removably attaching the antenna module to the communication device such that the antenna module and the communication device form a single mobile unit when attached. The activation control mechanism selectively electrically couples the external antenna to the communication device when the antenna module is attached to the communication device, so as to selectively route signal transmission and/or reception through either the built-in antenna of the communication device or the external antenna of the antenna module when the antenna module is attached to the communication device. In one preferred embodiment, the activation control mechanism is an activation button, and pressing the activation button alternately makes and breaks electrical contact between a connector of the antenna module and a corresponding connector of the communication device.

In accordance with another aspect of the present invention, there is provided a wireless communication device that includes a built-in antenna, and a detachable antenna module. The detachable antenna module includes an external antenna, an activation control mechanism, and at least one attachment feature for removably attaching the antenna module to the communication device such that the antenna module and the communication device form a single mobile unit when attached. When the antenna module is not attached to the communication device, signal transmission and/or reception is routed through the built-in antenna. When the antenna module is attached to the communication device, the activation control mechanism selectively electrically couples the external antenna to the communication device, so as to selectively route signal transmission and/or reception through either the built-in antenna or the external antenna of the antenna module when the antenna module is attached to the communication device.

DETAILED DESCRIPTION

The present invention, according to a preferred embodiment, overcomes problems with the prior art by providing a detachable antenna module that gives a single portable electronic communication device the advantages of both a built-in antenna and an external antenna.

More specifically, preferred embodiments of the present invention provide a detachable antenna module that can be attached to a portable electronic communication device having a built-in antenna, such as a wireless phone (e.g., cellular phone). Preferably, the detachable antenna module and the communication device form a single mobile unit when attached together. The preferred detachable antenna module includes an antenna and an activation control mechanism. When attached to the communication device and activated, communication signals (e.g., radio frequency or "RF" signals) are routed through the external antenna of the antenna module rather than through the built-in antenna of the communication device. Thus, the communication device uses an external antenna that is more powerful than its own built-in antenna to provide improved signal performance, which is particularly useful in fringe areas. The detachable antenna module enables the communication device to be adaptable between built-in and external antenna configurations, and thus the advantages of both antenna configurations are provided by a single communication device.

Figure 1:
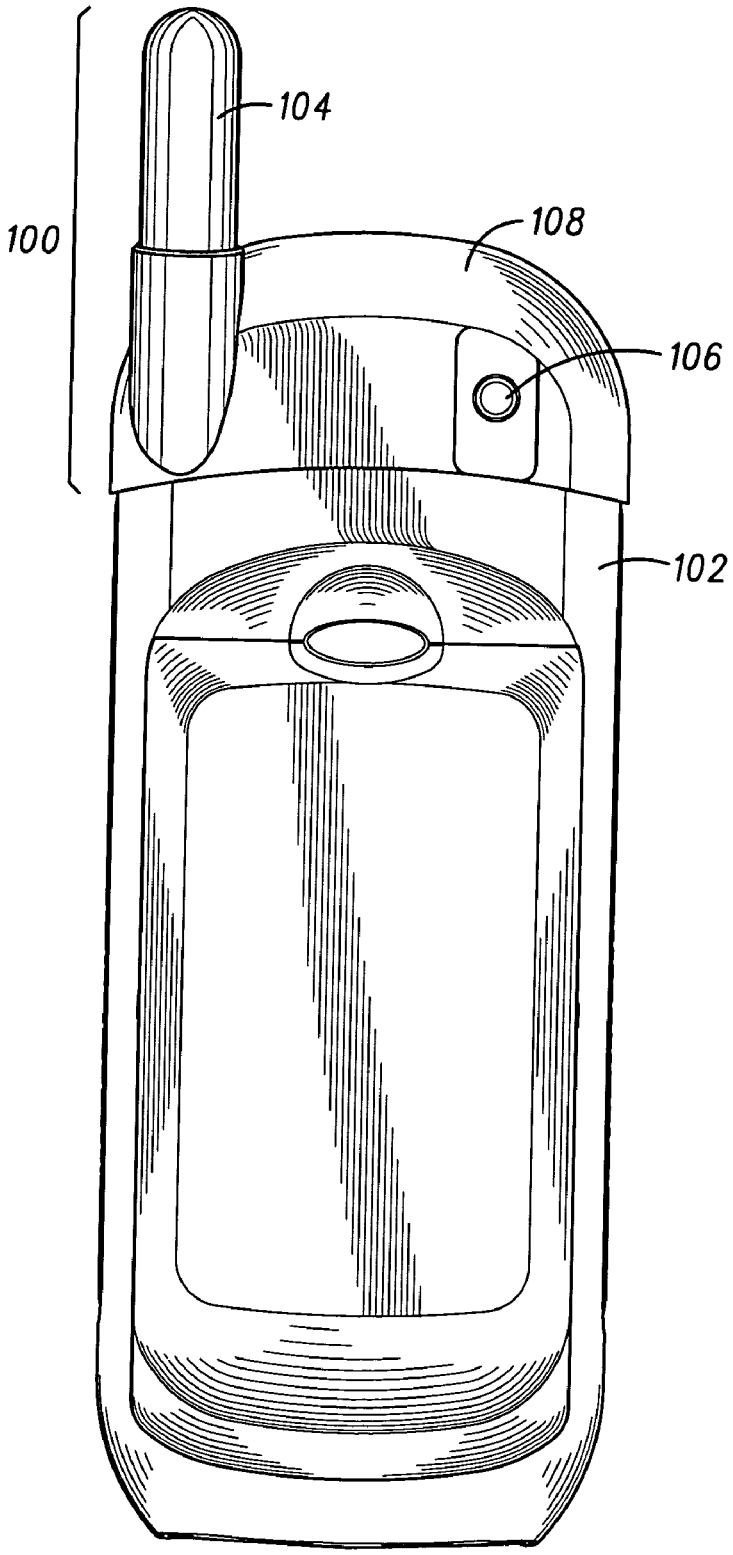
FIG. 1 shows a back view of a detachable antenna module according to a preferred embodiment of the present invention attached to an exemplary portable electronic communication device.

FIG. 1 shows a back view of a detachable antenna module according to a preferred embodiment of the present invention. The antenna module 100 is attached to a wireless phone 102. As shown in FIG. 1, the detachable antenna module 100 includes an external antenna 104 and, generally, a main body 108. An activation button 106 is incorporated into the antenna module 100 to selectively route communication signals.

Preferably, the main body is made of plastic. The external antenna 104 can be of any length; for example, in the preferred embodiment, the external antenna 104 is an electrical ¼-wave or ½-wave antenna, depending on the desired antenna performance. Furthermore, to make the antenna mechanically shorter, in the preferred embodiment the antenna or a portion thereof is formed with a helical structure or a flat meander structure. In the preferred embodiment, the external antenna 104 is extendable/retractable, and can retract, either partially or entirely, to a position within the main body 108 of the antenna module 100. In further embodiments, any desired physical configuration of the external antenna 104 in relation to the main body 108 can be implemented. For example, any desired portion of the external antenna 104 can be fixed in a position external or internal to the main body 108, and the external antenna 104 can be designed to extend/retract to any desired position in relation to the main body 108. In some embodiments, the external antenna 104 is in a fixed position entirely or partially within the main body 108 of the module 100. Regardless of the configuration and position of the external antenna 104 with respect to the main body 108 of the detachable antenna module 100, the external antenna 104 is external to the wireless phone 102.

The activation button 106 is used to cause the communication signals to bypass the built-in antenna of the wireless phone 102 and instead be routed through the external antenna 104 of the detachable antenna module 100. In the preferred embodiment, each press of the activation button 106 toggles between use of the external and built-in antennas. While the activation button 106 is the activation control mechanism implemented in the antenna module of the preferred embodiment, further embodiments have other activation control mechanisms that can be manipulated by a user to selectively route the signals, such as a toggle switch or other type of switch. Moreover, in some embodiments, the communication signal can be routed automatically. For example, in one embodiment, attaching the antenna module 100 to the wireless phone 102 automatically causes the signal to be routed through the external antenna 104.

It should be noted that while a wireless phone (e.g., cellular phone) is used as the exemplary communication device 102 throughout this description, the communication device 102 can be virtually any portable electronic communication device having some form of built-in antenna for signal reception and/or transmission, such as a two-way radio (e.g., a "walkie-talkie"), a cordless phone, a pager, a text messaging device, a portable or handheld computer (e.g., such as a computer with a wireless LAN card), an internet browser, a personal digital assistant (PDA), or a satellite communication device such as a global positioning system (GPS). Further, the communication device 102 is not limited to a device that provides direct communication between two or more individuals, but rather can be any device that transmits signals to and/or receives signals from an external source, such as a portable radio or portable television. In general, any electronic device that utilizes a built-in antenna for signal reception and/or transmission could benefit from the detachable antenna module of the present invention.

It should also be noted that the term "built-in antenna" is meant to include any antenna that is permanently attached so as to be part of the communication device itself. Thus, the "built-in antenna" can be partially or fully external to the other components of the phone device and can be extendable/retractable. For example, the "built-in antenna" can have a portion that is located within a protrusion in an otherwise substantially rectangular phone housing. Thus, the "built-in antenna" is a permanent part of the communication device, while the "external antenna" is a part of the detachable antenna module.

Figure 2:
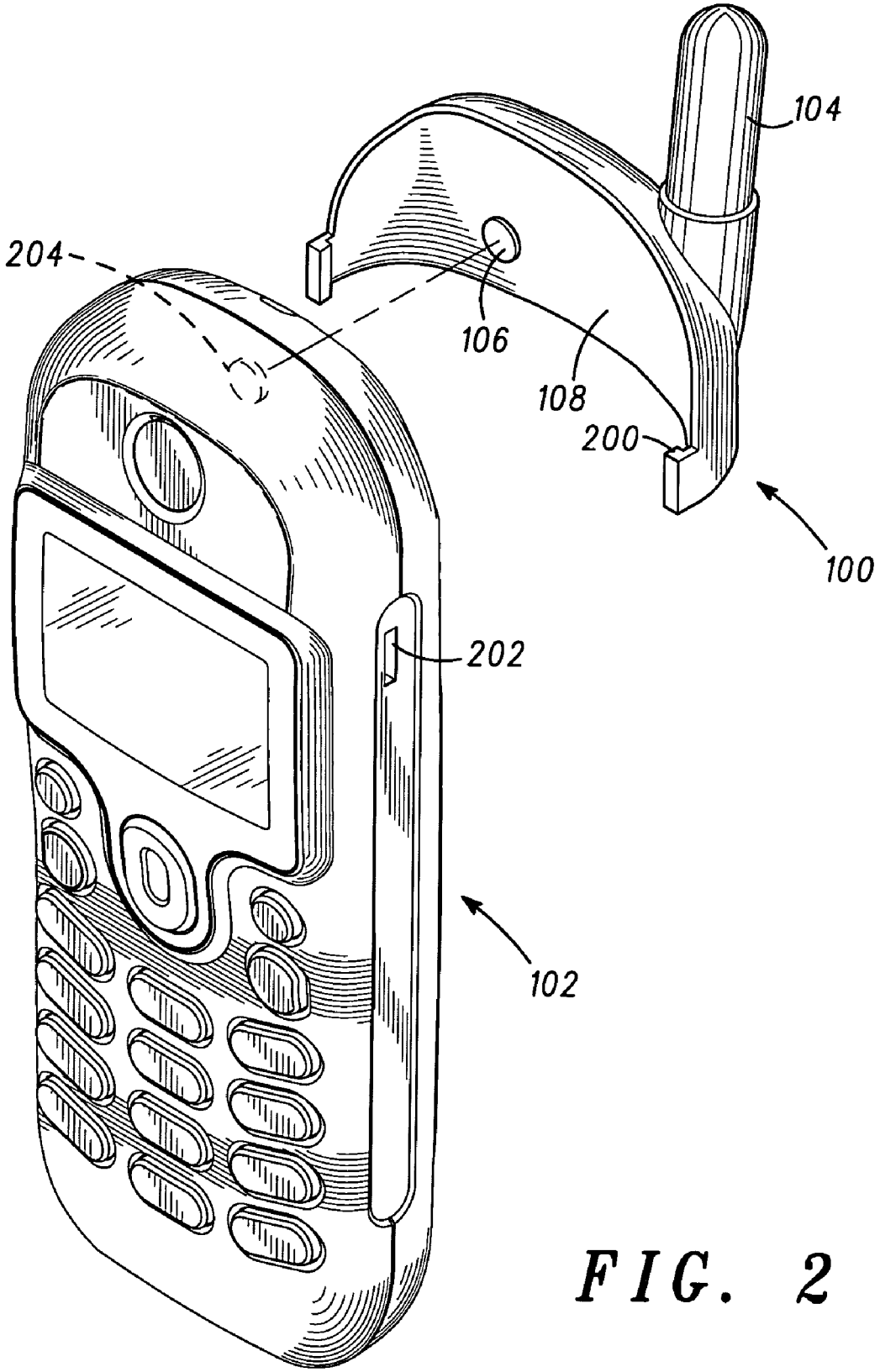
FIG. 2 shows an isometric view of the detachable antenna module of FIG. 1 detached from the exemplary communication device.

FIG. 2 shows an isometric view of the antenna module 100 of FIG. 1 detached from the wireless phone 102. As shown, the antenna module 100 includes attachment features that facilitate its attachment to the wireless phone 102. In this preferred embodiment, knobs or tongues 200 are provided on the antenna module 100 and corresponding grooves or indentations 202 are provided in the body of the wireless phone 102 (in FIG. 2 a groove 202 is only visible on one side due to the drawing perspective).

The tongue 200 on the antenna module 100 fits into the corresponding groove 202 on the wireless phone 102 during attachment of the antenna module 100 to the wireless phone 102. Thus, the groove 202 serves as an attachment point for receiving the tongue 200. The interaction of the tongue 200 and the groove 202 facilitates secure attachment of the antenna module 100 to the body of the wireless phone 102, and generally also facilitates alignment of the antenna module 100 with the wireless phone 102 during attachment. Thus, in this embodiment, the interaction of the tongue 200 and groove 202 enables the antenna module 100 to "clip-on" or "snap-on" to the wireless phone 102.

The wireless phone 102 also has an external RF connector interface 204, which connects to an RF switch of the wireless phone 102. Preferably, the activation button 106 on the antenna module lines up with the RF connector interface 204 when the antenna module 100 is attached to the wireless phone 102. The RF connector interface 204 can receive an external RF connector so as to allow communication signals to be routed through the external RF connection instead of the phone's built-in antenna. In this embodiment, the RF connector interface 204 is a receptacle (i.e., the "female" portion of the connector) for receiving a corresponding "male" external RF connector. An exemplary RF connector and RF switch configuration is described in greater detail below.

Although a tongue-and-groove mechanism is the exemplary attachment mechanism used in the embodiment described above, the present invention is not so limited. Any suitable attachment mechanism can be used to attach the antenna module to the wireless phone (or other communication device). Furthermore, depending on the specific application, there can be any number of such attachment features of any size, and they can be located at any desired positions on the antenna module and the wireless phone.

The attachment mechanism of FIG. 2 utilizes tongues because wireless phones and other communication devices typically already have grooves as a standard feature for receiving a belt-clip. Thus, such embodiments of the antenna module can simply be attached to the wireless phone instead of the belt-clip, so that it is not necessary to change the design of the wireless phone. To allow for attachment of a belt-clip when the antenna module is attached to the belt-clip grooves on the wireless phone, some embodiments of the antenna module include additional grooves (or another attachment mechanism) for receiving the belt-clip (or other accessory). Thus, in such embodiments, the antenna module is attached to the wireless phone, and the belt-clip is attached ("piggy-backed") to the antenna module. Alternatively, the wireless phone can include separate attachment mechanisms for the antenna module and the belt-clip (or other accessory). For example, the phone can have one set of grooves for receiving the antenna module and another set of grooves for receiving the belt-clip. Alternatively, the phone could have an elongated groove of sufficient size for receiving both the antenna module and the belt-clip to be attached.

Figure 3:
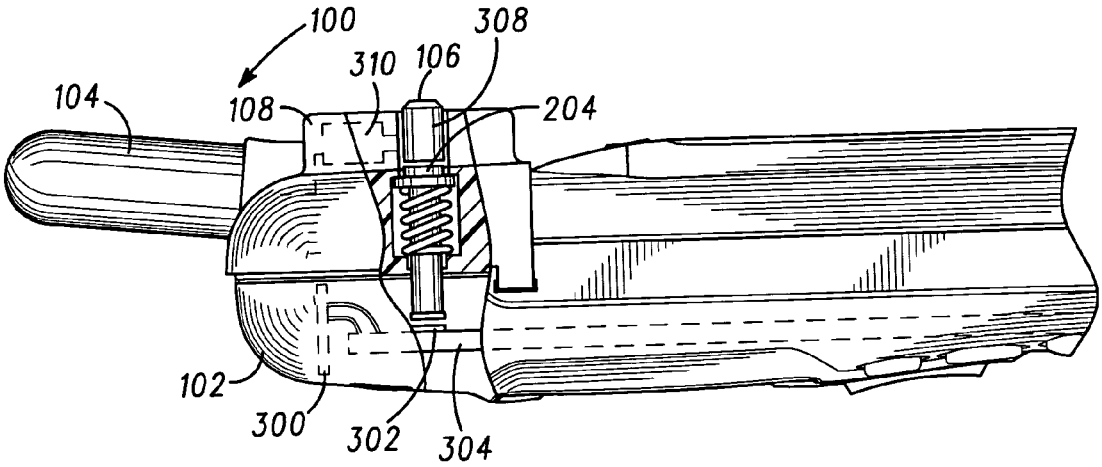
FIG. 3 is a diagram showing a more detailed side view of a detachable antenna module according to one embodiment of the present invention.

FIG. 3 is a diagram showing a side view of the internal and external components of a detachable antenna module according to one embodiment of the present invention. In FIG. 3, the detachable antenna module 100 is shown attached to a wireless phone 102. Within the wireless phone 102, a built-in antenna 300 and an RF switch 302 are connected to a printed circuit board 304. The RF switch 302 is connected to an external RF connector interface 204 that can receive an external RF connector. The detachable antenna module 100 includes an external antenna 104, a matching network 310, an activation button 106, and an external RF connector 308 (e.g., a 50 ohm RF connector). The matching network 310 is coupled between the external antenna 104 and the RF connector 308. The matching network 310 is an optional component for matching the impedance of the external antenna 104 to the impedance of the RF switch 302 (e.g., 50 ohms) in order to minimize signal loss.

The external RF connector 308 is coupled to the activation button 106 (or some other control mechanism), and is positioned so as to mate with the RF connector interface 204 when the antenna module 100 is attached to the wireless phone 102. In this embodiment, an electrical connection is made by bringing the RF connector 308 of the antenna module 100 into contact with the RF connector interface 204 such that the RF connector interface 204 contacts the RF switch 302 on the printed circuit board 304. Conversely, electrically separating the RF connector 308 and the RF switch 302 breaks the electrical connection. The activation button 106 is a toggle switch that positions the RF connector 308 so as to selectively electrically connect it to the RF switch 302. More specifically, pressing the activation button 106 alternately brings the RF connector 308 into electrical coupling with the RF switch 302 (via the RF connector interface 204), and electrically separates the RF connector 308 and the RF switch 302. Preferably, this is a blind connection and all of the contacts are gold-plated in order to minimize signal loss and prevent corrosion.

Many wireless phones already have an external RF connector interface and an RF switch for allowing factory testing of the phone and/or for interfacing with the holster of a car kit (i.e., to connect to an external antenna permanently attached to the car). Thus, the use of such a connection mechanism allows the antenna module to be used without having to change the design of the wireless phone.

During operation, the wireless phone 102 utilizes its built-in antenna 300 for signal transmission and reception in the absence of the antenna module 100. When the antenna module 100 is attached, the wireless phone 102 uses either the external antenna 104 or the built-in antenna 300 for signal transmission and reception based on the state of the activation button 106. In particular, when the antenna module 100 is first attached to the wireless phone 102, the built-in antenna 300 is used for signal transmission and reception. When the user first presses the activation button 106, the external RF connector 308 is brought into electrical contact with the RF switch 302. This causes signal transmission and reception to be routed through the external antenna 104, instead of the built-in antenna 300. If the user again presses the activation button 106, the RF connector 308 is disengaged from the RF switch 302. This causes signal transmission and reception to again be routed through the built-in antenna 300. Similarly, if the antenna module 100 is detached from the wireless phone 102, the RF connector 308 is disengaged from the RF switch 302 and signal transmission and reception is routed through the built-in antenna 300.

While the embodiment described above utilizes a toggle switch-type activation button as the control mechanism for physically connecting and disconnecting the external connector and the RF switch, any known control mechanism can be used to selectively route signal transmission and reception through the external antenna. Similarly, while an external connector and RF switch are used in the embodiment described above, any type of electrical connectors can be used to electrically connect the antenna module and the communication device through the connection interface on the communication device. For example, in one embodiment the external connector is directly connected to a contact or other connector on the printed circuit board when the antenna module is attached, and the phone itself controls the routing of communication signals (either automatically or based on user input or preferences). Further, in some embodiments, signal transmission and reception is automatically routed through the external antenna 104 upon attachment of the antenna module 100 to the wireless phone 102. This is achieved in one embodiment by changing the initial state of the toggle switch when the antenna module is attached to the phone (i.e., the RF connector and RF switch initially mate upon attachment). In another embodiment, the activation button is omitted so that the RF connector 308 is always coupled to the printed circuit board 304 when the antenna module is attached.

Figure 4:
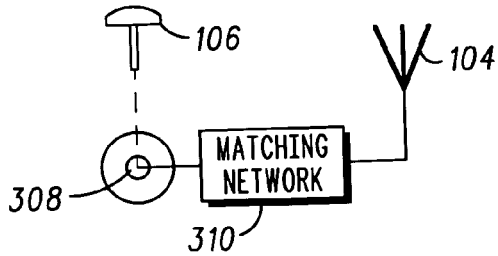
FIG. 4 is a block diagram illustrating a detachable antenna module according to a preferred embodiment of the present invention.

FIG. 4 is a block diagram illustrating a detachable antenna module according to a preferred embodiment of the present invention. As shown, the matching network 310 is coupled between the external antenna 104 and the RF connector 308. Also shown is the interaction of the activation button 106 with the connector 308 in accordance with the preferred embodiment of the present invention. As explained above, the activation button functions to toggle the electrical connection (i.e., alternately connect and disconnect) between the RF connector 308 and the RF switch 302.

Figure 5:
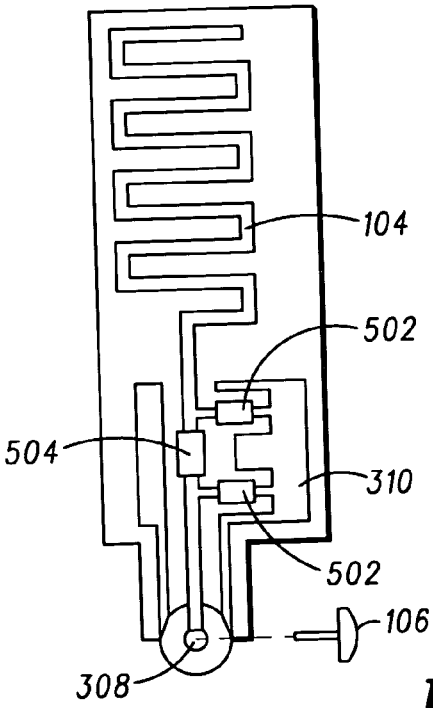
FIG. 5 shows in more detail the components of the detachable antenna module of one exemplary embodiment of the present invention

FIG. 5 illustrates in more detail the components of the detachable antenna module of one exemplary embodiment of the present invention. As shown, the external antenna 104 is a flat meandering line that is printed on a flex substrate (or a thin printed circuit board). The matching network 310 can be printed on or attached to the same substrate, and includes the necessary components to match the impedance of the external antenna to the impedance of the communication device (e.g., 50 ohms) in order to minimize signal loss. For example, in this exemplary embodiment the matching network includes two inductors 502 and one capacitor 504. The components of the matching network are sized so as to provide the desired impedance (e.g., 50 ohms) for the external antenna.

The RF connector 308 of the detachable antenna module is attached to the substrate and the activation button 106 is provided to selectively electrically connect the RF connector 308 with the communication device. Preferably, this flex circuit is overmolded into the plastic body of the antenna module. In further embodiments, the external antenna 104 has some other structure, such a helical or straight wire embedded into the plastic body of the antenna module.

Accordingly, the present invention offers significant advantages. For example, the present invention enables the advantages of both a built-in antenna and an external antenna to be provided with a single portable electronic communication device. The communication device has a built-in antenna so consumers can enjoy the benefits associated with built-in antennas (such as compactness, enhanced aesthetic appearance, and reduced likelihood of antenna damage). At the same time, when enhanced antenna performance is desirable or necessary (such as in fringe areas), the detachable antenna module can be attached to the communication device to provide increased signal coverage/range, strength, and/or clarity as compared with the built-in antenna.

Further, the detachable antenna module of the present invention allows service providers to offer stylish wireless phones that have built-in antennas without having to sacrifice improved coverage in fringe areas. The manufacturer only has to design and produce a single model of a communication device and can offer the detachable antenna module as an accessory for use in those situations which demand better antenna performance. This can lead to reduced development and manufacturing costs, as well as a larger market and increased sales for the communication device.

Moreover, the present invention enables a communication device to be more adaptable by allowing a manufacturer or third party to offer alternative antennas for the communication device. The present invention allows manufacturers to provide antennas that are optimized for different applications, antennas having different aesthetic styles or designs, or upgraded antennas that are based on improved or newer technology. Consequently, the present invention allows consumers to easily upgrade or customize a communication device with an improved or alternative antenna without having to purchase a new communication device.

Further, the detachable antenna module of the preferred embodiment can be sold as an accessory for existing wireless phones (or other communication devices). In particular, because the preferred embodiment utilizes design features that are already present on many wireless phones (such as belt-clip attachment grooves and the RF connector interface), the detachable antenna module can readily be used with many wireless phones and other communication devices that are already on the market from a wide variety of manufacturers.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. A detachable antenna module for attachment to a wireless communication device that has a built-in antenna, the detachable antenna module comprising:

at least one attachment feature on the antenna module for removably attaching the antenna module to the communication device such that the antenna module and the communication device form a single mobile unit when attached;

an external antenna, wherein the external antenna is built into the detachable antenna module; and an activation control mechanism for selectively electrically coupling the external antenna to the communication device when the antenna module is attached to the communication device, so as to selectively route at least one of signal transmission and signal reception through one of the built-in antenna of the communication device and the external antenna of the antenna module when the antenna module is attached to the communication device.

2. The detachable antenna module according to claim 1, further comprising:

a connector coupled to the external antenna, wherein the connector selectively electrically couples the external antenna to a corresponding connector of the communication device based on the state of the activation control mechanism.

3. The detachable antenna module according to claim 2, wherein the activation control mechanism is an activation button, and pressing the activation button alternately makes and breaks electrical contact between the connector of the antenna module and the corresponding connector of the communication device so as to alternately electrically couple and electrically uncouple the external antenna and the communication device.

4. The detachable antenna module according to claim 2, wherein the connector of the antenna module is a 50 ohm RF connector.

5. The detachable antenna module according to claim 2, further comprising a matching network coupled to the external antenna, the matching network matching the impedance of the external antenna to the impedance of the corresponding connector of the communication device.

6. The detachable antenna module according to claim 5, wherein the external antenna and the matching network are printed on one of a flex substrate and a thin printed circuit board.

7. The detachable antenna module according to claim 1, wherein the external antenna is printed on a flex substrate.

8. The detachable antenna module according to claim 1, wherein the external antenna is printed on a thin printed circuit board.

9. The detachable antenna module according to claim 1, wherein the external antenna is extendable/retractable.

10. The detachable antenna module according to claim 1, wherein the at least one attachment feature Includes a plurality of tongues that fit into corresponding grooves on the communication device to securely attach the antenna module to the communication device.

11. A wireless communication device comprising:

a built-in antenna; and a detachable antenna module including an external antenna built into the detachable antenna module, an activation control mechanism, and at least one attachment feature for removably attaching the antenna module to the communication device such that the antenna module and the communication device form a single mobile unit when attached, wherein at least one of signal transmission and signal reception is routed through the built-in antenna when the antenna module is not attached to the communication device, and the activation control mechanism selectively electrically couples the external antenna to the communication device when the antenna module is attached to the communication device, so as to selectively route at least one of signal transmission and signal reception through one of the built-in antenna and the external antenna of the antenna module when the antenna module is attached to the communication device.

12. The wireless communication device according to claim 11, further comprising:

an external connector interface; and a connector, wherein the antenna module further includes an external connector that interfaces with the external connector interlace when the antenna module is attached to the communication device, the external connector being coupled to the external antenna, and the external connector selectively electrically couples the external antenna to the connector based on the state of the activation control mechanism.

13. The wireless communication device according to claim 12, wherein the activation control mechanism is an activation button, the connector is an PF switch, and pressing the activation button alternately makes and breaks electrical contact between the external connector and the RF switch so as to alternately electrically couple and electrically uncouple the external antenna and the communication device.

14. The wireless communication device according to claim 13, wherein the external connector is a 50 ohm RF connector.

15. The wireless communication device according to claim 13, further comprising a matching network coupled to the external antenna, the matching network matching the impedance of the external antenna to the impedance of the RF switch.

16. The wireless communication device according to claim 15, wherein the external antenna and the matching network are printed on one of a flex substrate and a thin printed circuit board.

17. The wireless communication device according to claim 11, further comprising:

a plurality of grooves on the communication device, wherein the at least one attachment feature of the antenna module includes a plurality of tongues that fit into the grooves on the communication device to securely attach the antenna module to the communication device.

18. The wireless communication device according to claim 11, wherein the communication device is a wireless phone.

19. The wireless communication device according to claim 11, wherein the communication device is one of a two-way radio, a text messaging device, a portable computing device having a wireless LAN card, and a global positioning system.

* * * * *